US006781299B2

(12) United States Patent
Lee

(10) Patent No.: US 6,781,299 B2
(45) Date of Patent: Aug. 24, 2004

(54) TENSION MASK ASSEMBLY

(75) Inventor: Tae Hoon Lee, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 16 days.

(21) Appl. No.: 09/848,283

(22) Filed: May 4, 2001

(65) Prior Publication Data

US 2002/0043918 A1 Apr. 18, 2002

(30) Foreign Application Priority Data

May 17, 2000 (KR) ..... 2000-26439

(51) Int. Cl.[7] ..... H01J 29/80

(52) U.S. Cl. ..... 313/407; 313/408; 313/402; 313/404

(58) Field of Search ..... 313/402, 407, 313/404, 408, 406; 248/351, 357

(56) References Cited

U.S. PATENT DOCUMENTS 5,644,192 A * 7/1997 Ragland, Jr. ..... 313/402
5,898,259 A * 4/1999 Reyal ..... 313/407
6,046,535 A * 4/2000 Jung ..... 313/402
6,268,688 B1 * 7/2001 Tani et al. ..... 313/402
6,472,807 B1 * 10/2002 Yoon ..... 313/407

* cited by examiner

*Primary Examiner*—Nimeshkumar D. Patel
*Assistant Examiner*—Holly Harper
(74) *Attorney, Agent, or Firm*—Fleshner & Kim, LLP

(57) ABSTRACT

A tension mask assembly for a flat color Braun tube is disclosed, in which each of main frames is bent at a middle portion in the width direction, and has a portion perpendicular to a tension mask defining a partition and another portion opposite to the tension mask defining a lower plane, wherein widths of a middle portion and both ends of the lower plane are formed in the range of the following equation:

$$0 < \frac{w_1 - w_2}{w_2} \leq 1.0.$$

Also, it is possible to prevent the tension mask assembly from howling, and to prevent the tension mask from being deformed or broken during a heat treatment, and stiffness of the main frames can be enhanced.

23 Claims, 6 Drawing Sheets

TENSION MASK ASSEMBLY

BACKGROUND OF THE INVENTION

1. Field of the Invention

The present invention relates to a tension mask assembly mounted to a Braun tube, and more particularly, to a main frame for allowing the tension mask to be under uniform tension across the whole area.

2. Description of the Related Art

In general, the tension mask is a thin plate mounted at the rear of a panel forming a screen of a Braun tube with a number of electron beam through holes at the upper surface thereof, and is subjected to tension from a frame so that electron beams passing the through holes can be effectively color selected to form an image on the screen.

The tension mask is provided in a tension mask assembly so as to be fixed within a Braun tube, in which the tension mask assembly includes a pair of sub-frames 3 formed by bending both ends of angled bars, a pair of main frames 2 welded to the upper surfaces of both ends of the sub-frames 3 with an L-shaped or triangular welded section, and the tension mask welded to the upper part of the main frames 2 with dot-shaped slots or grill-shaped electron beam through holes as shown in FIG. 1 and FIG. 2.

The tension mask assembly is assembled as follows:

As shown in FIG. 2, in the tension mask assembly, when the sub-frame 3 is inwardly bent due to a force F applied to both ends of the main frame 2, the end position of the main frame 2 welded to the upper part thereof is displaced from the initial point A1 to A3.

The tension mask 1 is welded to the upper part of the main frame 2 displaced as above. When the force F applied to the main frame is removed, the main frame 2 stresses the tension mask 1 as the sub-frame 3 returns to the original position.

However, when the force F is removed, the end position of the main frame 2 is displaced from the position A3 only to A2 thereby causing deformation as much as an interval from A1 to A2, which is up to 13 mm in a longitudinal middle portion of the main frame and about 2 mm in both longitudinal edges in a 32 inch type Braun tube so that the middle portion is strained in a greater amount compared to both edges.

Such deformation is due to the fact that both longitudinal ends of the main frame are directly supported whereas the middle portion of the main frame is strained without any restriction when the force F applied to the tension mask assembly is removed.

Therefore, in the tension mask assembly of the prior art, the middle portion of the main frame is deformed freely so that the middle portion of the tension mask welded to the main frame has a lower amount of tension compared to the edges.

As tension of the tension mask like this is varied along the longitudinal direction, the difference of the natural frequency is generated according to the longitudinal position of the tension mask, and in particular, the natural frequency is remarkably lowered in the middle portion.

Therefore, the tension mask easily resonates on sound wave or impact so that the landing position of the electron beam is varied according to the relative position change between a phosphor screen and the slot of the tension mask due to vibration of the tension mask, and a howling or color imbalance takes place on an image to degrade color purity.

Also, due to the difference of the natural frequency like this, it is difficult to adjust audible frequency range for generating vibration so as not to overlap with the natural frequency range.

Further, while the modulus of strain of a material after being tensioned by the frame should exist under the modulus of strain at the yield point in the tension mask, tension applied to the tension mask is increased due to thermal expansion of the main frame in a heat treating process so that a large amount of tension is concentrated to both ends of longer sides of the tension mask of the related art. Therefore, there is a problem that both ends of the longer sides of the tension mask may easily exceed the modulus of strain of the yield point to incur plastic deformation or break.

SUMMARY OF THE INVENTION

The present invention is proposed to solve the foregoing problems, and it is therefore an object of the invention to locally increase lower plane width of a main frame in a tension mask assembly composing a flat color Braun tube thereby to decrease strain of the main frame.

It is another object of the invention to apply uniform tension to the tension mask to prevent howling.

It is further another object of the invention to provide a tension mask assembly in which the tension mask is subjected to uniform tensile force to decrease the modulus of strain at the periphery of the tension mask thereby preventing plastic deformation or break of the tension mask in a heat treatment of the Braun tube.

Also, it is other object of the invention to restrict the main frame only to a certain portion in increase of width thereby avoiding increase of production cost.

According to an embodiment of the invention to solve the foregoing objects, it is provided a tension mask assembly comprising: a tension mask having electron beam through holes shaped as a slot or grill, a sub-frame for tensioning the tension mask, and main frames welded to the tension mask, wherein each of the main frames is bent at a middle portion in the width direction, and has a portion perpendicular to the tension mask defining a partition and another portion opposite to the tension mask defining a lower plane, wherein widths of a middle portion and both ends of the lower plane are formed in the range of the following equation:

$$0 < \frac{w_1 - w_2}{w_2} \leq 1.0,$$

herein, $w_1$ is the width of the middle portion, and $W_2$ is the width of both ends.

According to another embodiment of the invention to solve the foregoing objects, it is provided a tension mask assembly comprising: a tension mask having electron beam through holes shaped as a slot or grill, a sub-frame for tensioning the tension mask, and main frames welded to the tension mask, wherein each of the main frames has a partition perpendicular to the tension mask, a lower plane perpendicularly bent from the partition with a certain width to be opposed to the tension mask, and a support bent from the lower plane to support the partition at the outer edge, wherein widths of a middle portion and both ends of the lower plane are formed in the range of the following equation:

$$0 < \frac{y_1 - y_2}{y_2} \leq 1.0,$$

herein, $y_1$ is the width of the middle portion, and $y_2$ is the width of both ends.

It is preferred that widths of a middle portion and both ends of the support are formed in the range of the following equation:

$$0 < \frac{d_1 - d_2}{d_2} \leq 1.0,$$

herein, $d_1$ is the width of the middle portion, and $d_2$ is the width of both ends.

Preferred embodiments of the invention will be described in more detail in reference to the appended drawings, wherein features and advantages of the invention will be more apparent.

DETAILED DESCRIPTION OF THE PREFERRED EMBODIMENTS

Figure 1:
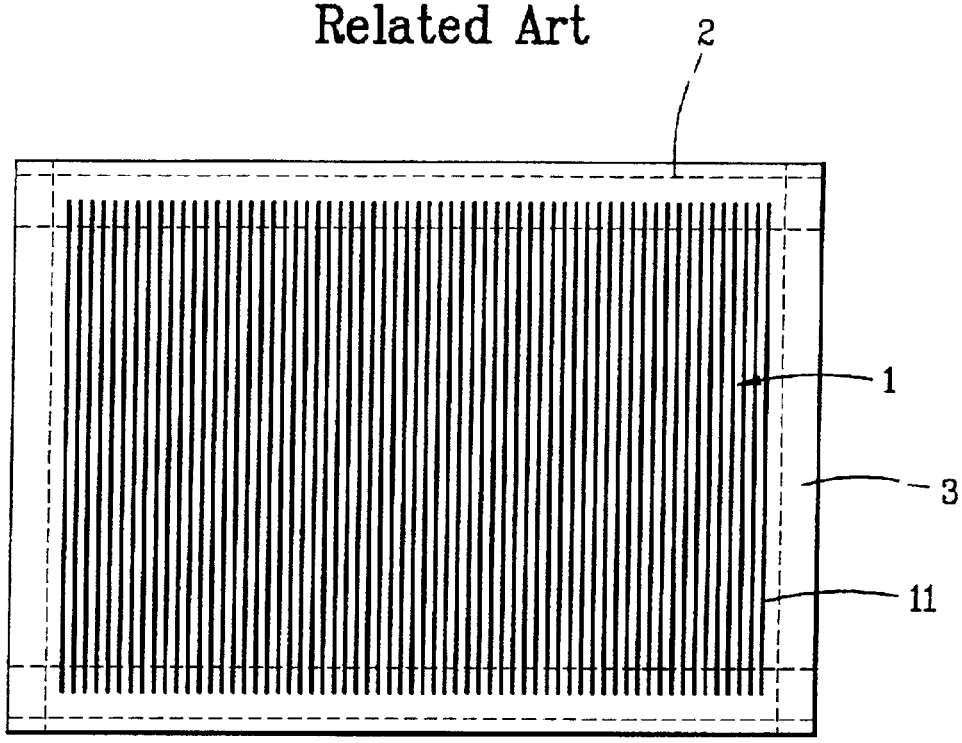
FIG.1 Related Art
FIG. 1 is a front elevation view for showing a tension mask assembly of the related art.
Figure 2:
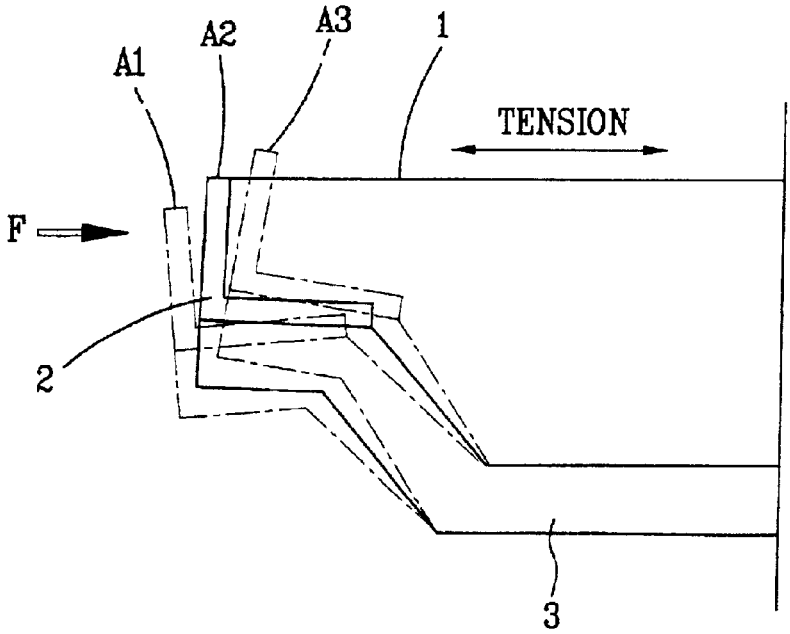
FIG.2 Related Art
FIG. 2 is a detailed cross sectional view for showing a manufacturing process of the tension mask assembly of the related art.

Hereinafter preferred embodiments of the invention capable of specifically realizing the foregoing objects of the invention will be described in reference to the appended drawings. In description of the embodiments according to the invention, the same terms and the same reference numerals are made to the same elements and additional explanation thereof will be omitted hereinafter.

Figure 3:
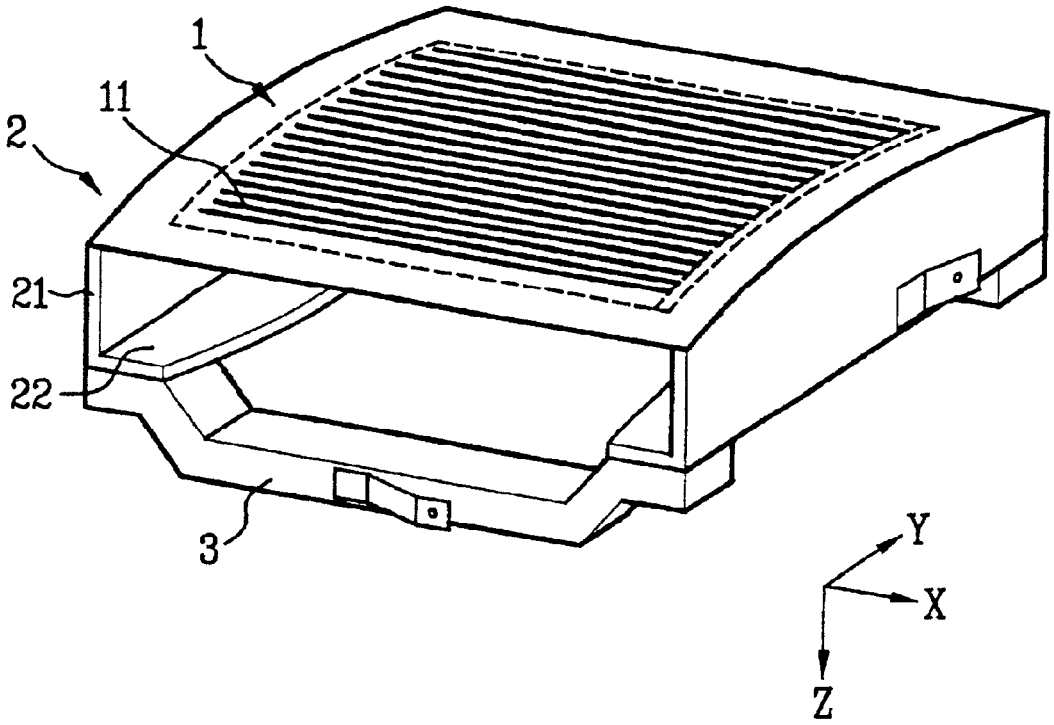
FIG. 3 is a perspective view for showing a tension mask assembly according to the invention.

FIG. 3 shows a tension mask assembly of the invention. A tension mask 1 comprises electron beam through holes 11 shaped as a slot or grill, and is composed of an inner side having the electron beam through holes 11 and edges without the through holes.

A frame for tensioning and fixing the tension mask 1 comprises main frames 2 welded so as to support the tension mask 1 along the longitudinal direction and a sub-frame 3 with an upper plane welded to the bottoms 22 of the main frames 2.

Figure 4A:
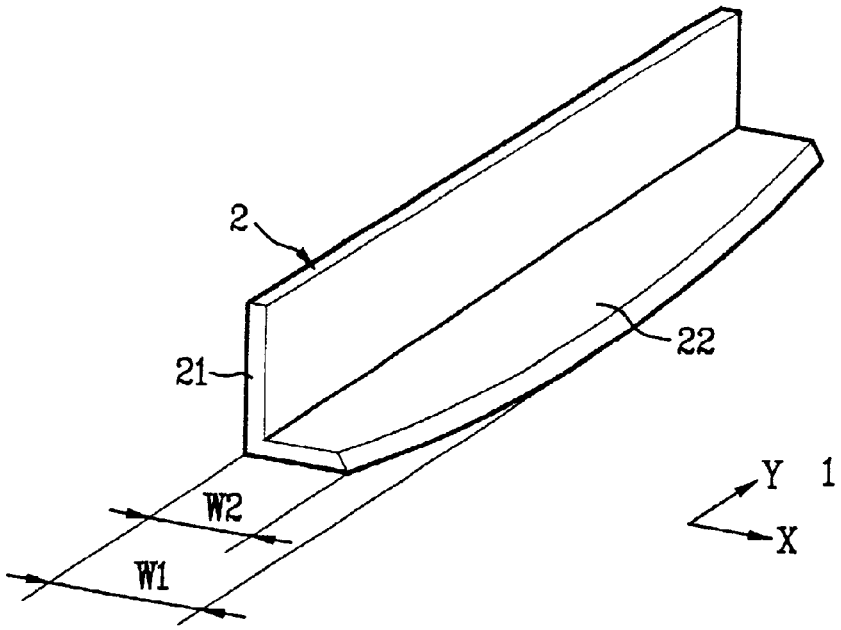
FIG. 4A and FIG. 4B are perspective views for showing main frames according to the invention.

To be more specific, as shown in FIG. 4A, the main frame 2 is so bent at a middle portion in the width direction that a portion perpendicular to the tension mask 1 defines a partition 21, another portion opposite to the tension mask 1 defines a lower plane 22, and thus the cross section is shaped as L when taken along the x-axial direction of the Braun tube.

Here, the lower plane 22 of the main frame 2 shaped as above is so curved that the inner side thereof varies in width along the y-axial direction of the Braun tube with the maximum width at a middle portion and the minimum width at both ends.

Here, the relation of the width $w_2$ at both ends of the lower plane 22 and $w_1$ is:

$$0 < \frac{w_1 - w_2}{w_2} \leq 1.0.$$

The maximum value of the middle portion width of the lower plane 22 of the main frame is selected within two times of both end width of the main frame to prevent that the middle portion width of the lower plane 22 is formed so large that electron beams are not landed on phosphor formed in the panel inner side and resultantly a screen is not reproduced.

Figure 4B:
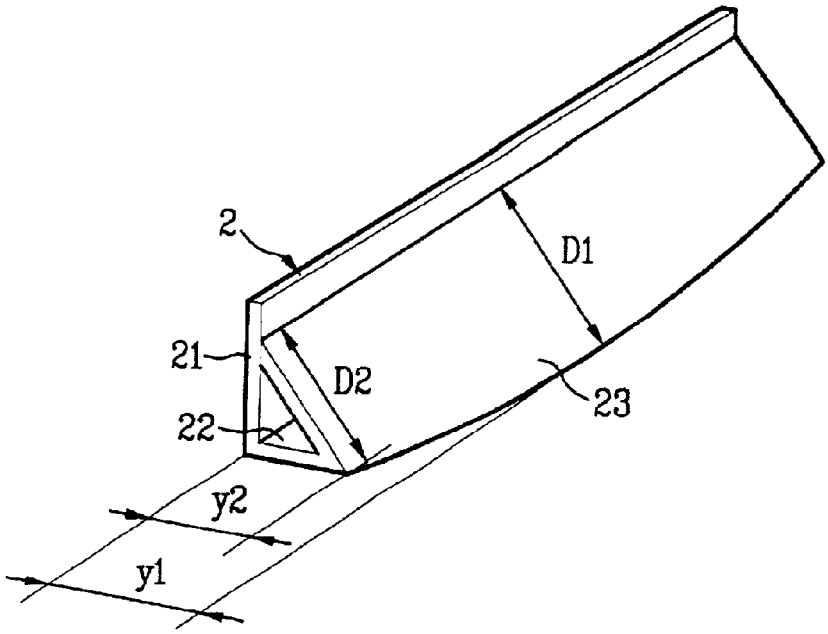

Meanwhile, as shown in FIG. 4B, another main frame 2 of the invention is manufactured to have a triangular longitudinal cross section, in which a partition 21 is perpendicular to the tension mask 1, a middle portion is bent perpendicularly to define a certain width of lower plane 22 opposite the tension mask 1, and a support 23 is inwardly bent from the edge of the lower plane 22 to support the partition 21 at the edge opposed to the bent line.

Here, the lower plane 22 of the main frame 2 has a width increasing as approaching a middle portion and decreasing as approaching both ends, in which the width $y_1$ of the middle portion and the width $y_2$ of both ends are given in the relation of:

$$0 < \frac{y_1 - y_2}{y_2} \leq 1.0.$$

The support 23 between the lower plane 22 and the partition 21 has a width increasing at a middle portion and decreasing at both ends, the width d1 at the middle portion and the width at both ends are given in the relation of:

$$0 < \frac{d_1 - d_2}{d_2} \leq 1.0.$$

In other words, the main frames 2 with the L-shaped or triangular longitudinal cross section have a configuration that the width of the lower plane 22, to which the sub-frame 3 is welded, increases as approaching the longitudinal center and decreases as approaching the ends.

The main frames 2 are welded to both upper planes of the sub-frame 3 bent as much as the width of the lower planes 22 of the main frames 2 so that the main frames 2 and the sub-frame 3 configured as above form a quadrangular-sectioned body for fixing the tension mask.

When the main frames 2 of the quadrangular body is forced at both ends, the sub-frame 3 is bent and the distance between both ends of the main frames is narrowed.

Longitudinal both ends of the tension mask 1 having the electron beam through holes are welded on the partitions 21 of the main frames.

When the force applied to the main frames 2 is removed, the sub-frame 3 returns to its original position due to stiffness while applying tension to the main frame 2 therewith. Here, the main frames 2 and the tension mask 1 are released from tension at the point where a self-restoring force formed in the main frame 2 and a resisting force of the tension mask 1 are equilibrated.

Figure 5:
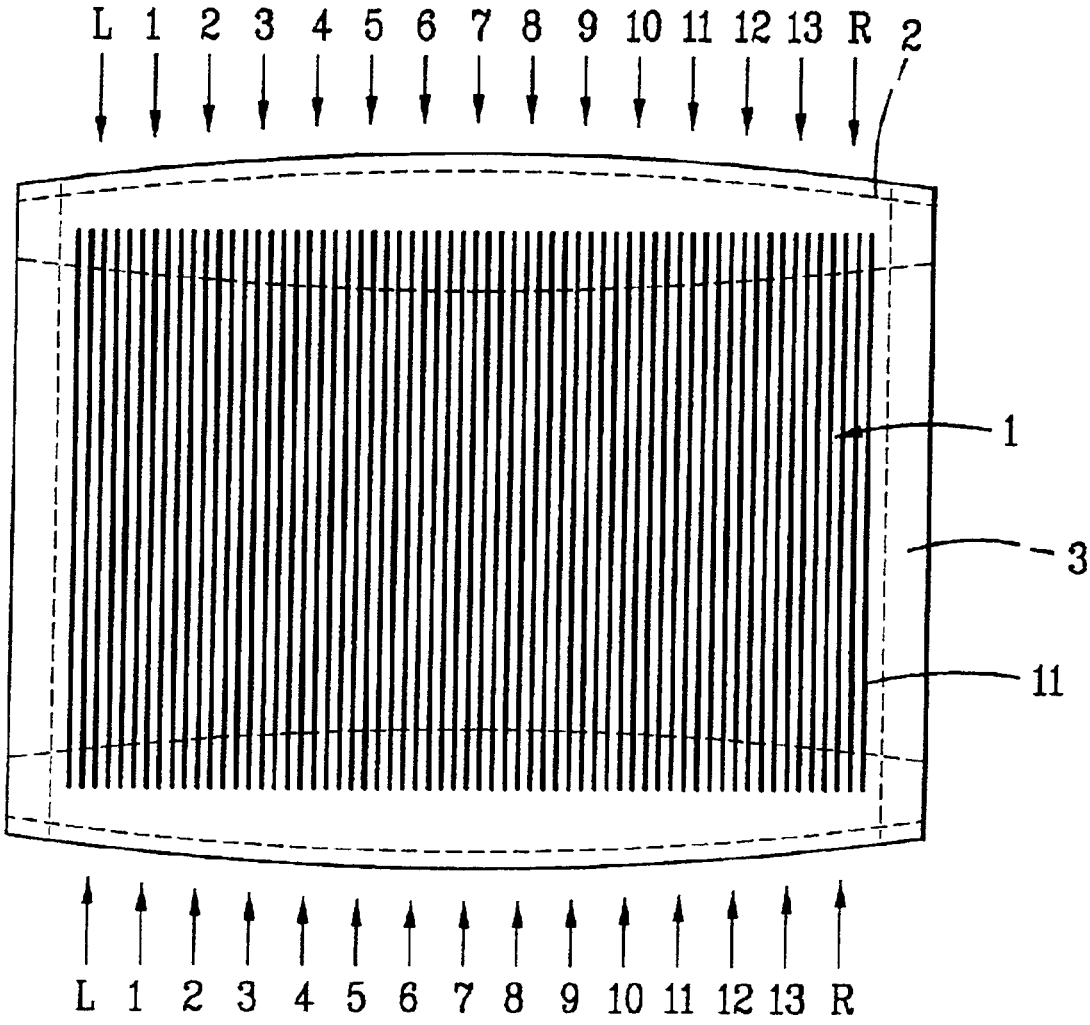
FIG. 5 is a front elevation view of the tension mask assembly according to the invention.

Meanwhile, it can be seen that the lower plane 22 of the main frame for maintaining tension of the tension mask 1 is longitudinally wide in the middle portion and narrowed at both ends in the tension mask of the invention as shown in FIG. 5.

Figure 6A:
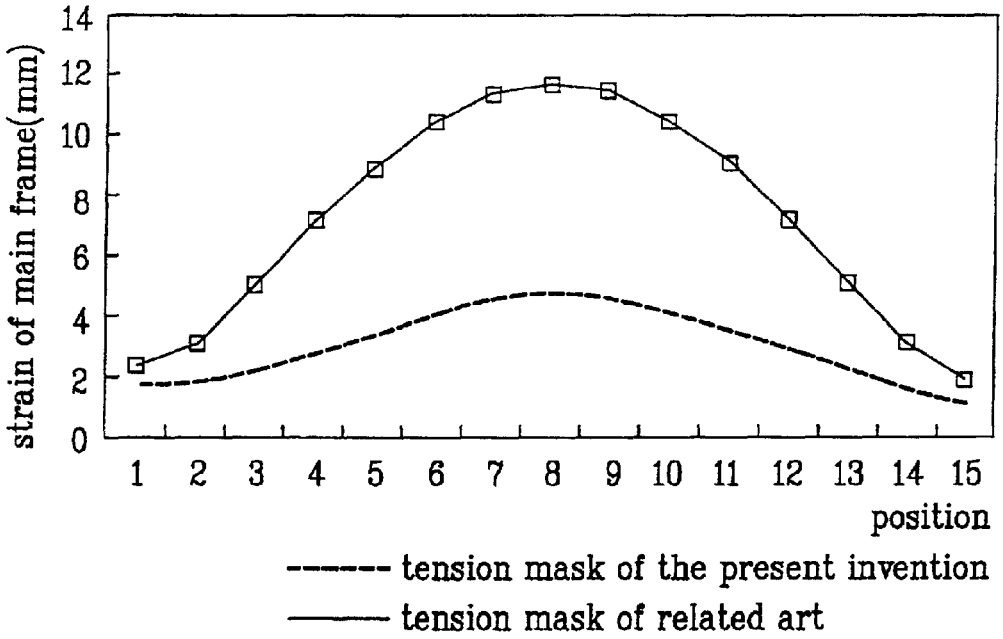
FIG. 6A through FIG. 6D are graphs for comparing the modulus of strain of the main frame, and tension, the modulus of strain and vibration frequency of a shadow mask taken according to positions of the tension mask of the invention shown in FIG. 5 with those of the tension mask of the related art.

Accordingly, referring to FIG. 6A for showing the modulus of strain according to the longitudinal position of the main frame 2 shown in FIG. 5, it can be seen that strained amounts in the middle portion and edges of the main frames of the invention indicated with a dotted line are decreased compared to those of the related art indicated with a solid line, and thus the range of strained amount is decreased.

This means that strain of the main frame middle portion is decreased since stiffness of the main frame is enhanced due to width increase of the middle portion lower planes.

In other words, stiffness improvement of the main frame 2 is indicated in Equation 1:

$$Y_{\max} \propto \frac{w_0 \times L^4}{E \times I},$$

herein, $Y_{max}$ is the maximum amount of strain in the tensioning direction at the longitudinal middle point of the main frames 2, $w_0$ is the load per unit length, L is the length of the main frames 2, E is the modulus of elasticity, and I is the inertial moment of the section.

These amounts of strain of the main frame in the tensioning direction can be decreased as the modulus of elasticity of the main frames is increased or the load application is decreased.

However, these items are fixed for obtaining required Braun tube size and howling features, and thus inapt for variation.

Therefore, as the inertial moment is increased, strain of the main frame in the tensioning direction is reduced, and the inertial moment can be increased according to increase of the lower plane width of the main frames since it indicates the multiplier of the perpendicular length up to an object about the rotary axis.

In this case, as the lower plane width of the main frames is uniformly increased, the inertial moment of the main frames 2 is increased, whereas the increased inertial moment applies excessive tension so that the tension mask 1 is subjected to a large amount of tensile force thereby incurring plastic deformation and raising production cost.

Therefore, the inertial moment of the middle portion in the longitudinal direction of the main frames subject to a large amount of strain is increased compared to the edges, in which stiffness of the tension mask is so adjusted that plastic deformation of the tension mask can be prevented while strained amount of the main frames 2 is reduced.

Figure 6B:
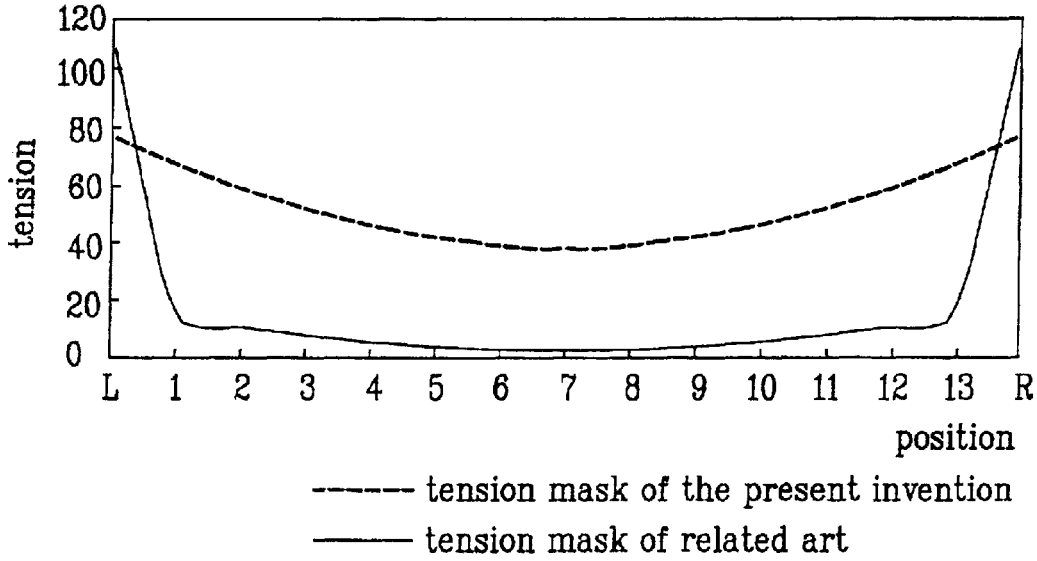

According to the main frame formed like this, the tension mask 1 is free from the localized concentration of tension in the longitudinal direction but has uniformly dispersed tension as shown in FIG. 6B.

Figure 6C:
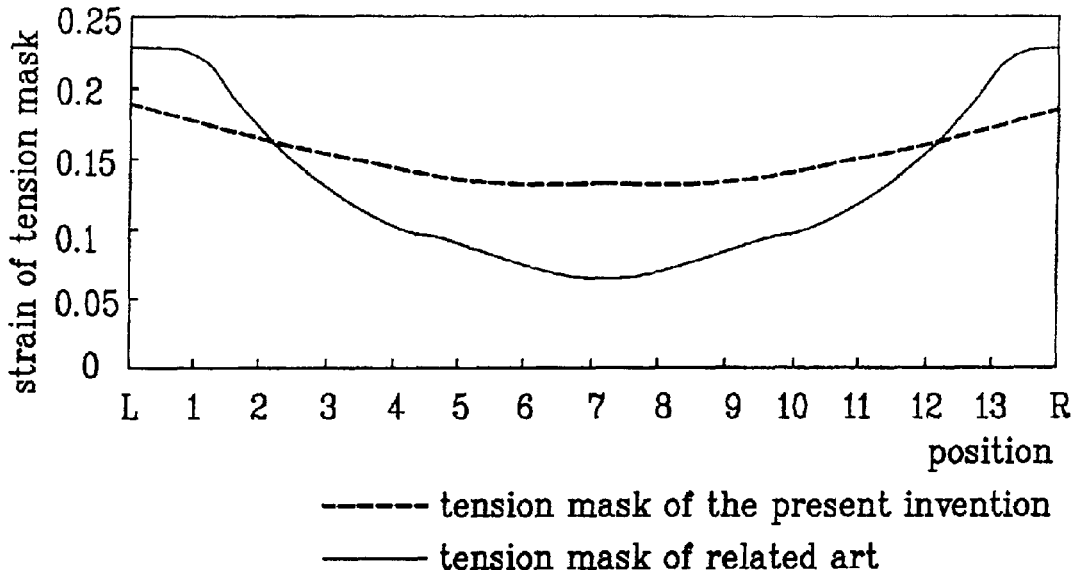

Referring to FIG. 6C, in the tension mask of the invention indicated with a dotted line, strain of the tension mask 1 takes place substantially uniform as indicated along the longitudinal axis across the whole area of the tension mask 1 designated along the transverse axis.

Figure 6D:
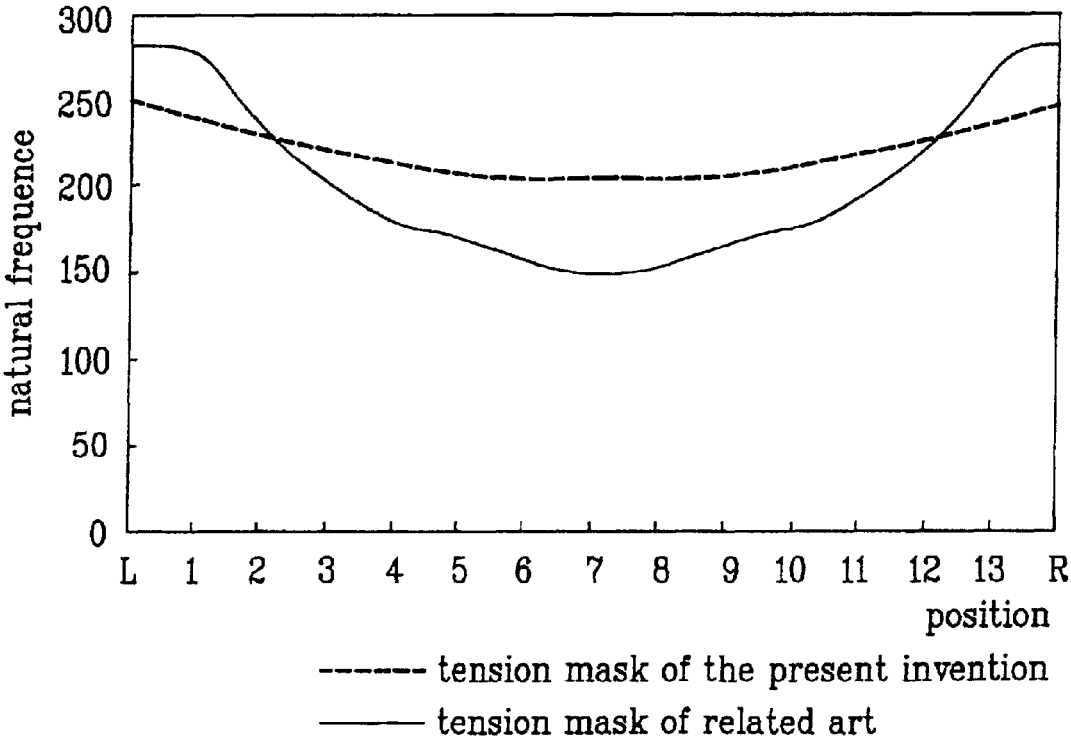

Also, as shown in FIG. 6D, the natural frequency according to the longitudinal tension mask 1 position of the traverse axis is also substantially uniform.

This means that the band range of the vibration frequency decreases, and accordingly an audible frequency band does not overlap with a vibration frequency band of the tension mask so that resonance is prevented to reduce howling of the tension mask.

Meanwhile, when the tension mask assembly is installed at the rear of a phosphor screen followed by a heat treatment at about 450° C., the main frames 2, the sub-frame 3 and the tension mask 1 made of metal are thermally expanded.

Here, since the sub-frame 3 has a thermal expansion coefficient larger compared to that of the tension mask 1 the tensile force applied to the main frames 2 and the tension mask 1 by the sub-frame 3 is increased.

However, since the tension mask 1 of the invention has the tensile force uniform in the longitudinal direction as shown in FIG. 6B, the tensile force is uniformly increased even in thermal expansion so that modulus of strain of the tension mask exists under the yield point thereby preventing plastic deformation or break of the tension mask 1.

As described hereinbefore, in the main frames of the invention, the lower planes have the middle portions increased in width compared to the edges so that strain of the main frames according to stiffness increase is reduced thereby allowing uniform tension of the tension mask.

Therefore, the natural frequency band of the tension mask is formed narrow so that howling is prevented to improve color selectivity and a band can be easily selected for preventing resonance of a speaker apparatus and the like for generating vibration thereby to improve productivity.

Also, since strained with the uniformly generated tensile force, the tension mask is prevented from plastic deformation and break due to thermal expansion in the heat treatment.

What is claimed is:

1. A tension mask assembly, comprising:

a tension mask having electron beam through holes;

at least one sub-frame for tensioning the tension mask; and main frames welded to the tension mask, wherein each of the main frames is bent at a middle portion in a width direction, and has a portion perpendicular to the tension mask defining a partition and another portion opposite to the tension mask defining a lower plane, and wherein widths of a middle portion and of both ends of the lower plane are formed in the range of the following equation:

$$0 < \frac{w_1 - w_2}{w_2} \leq 1.0,$$

where $W_1$ the width of the middle portion, and $W_2$ is the width of both ends.

2. The tension mask assembly according to claim 1, wherein the electron beam through holes are shaped as a slot or grill.

3. The tension mask assembly according to claim 1, wherein the main frames are welded to the at least one subframe.

4. The tension mask assembly according to claim 1, wherein a shape of the lower plane is one of curved, rounded, rectangular, triangular, or any combination thereof.

5. A cathode ray tube containing the tension mask assembly of claim 1.

6. A tension mask assembly, comprising:

a tension mask having electron beam through holes;

at least one sub-frame for tensioning the tension mask; and main frames welded to the tension mask, wherein each of the main frames has a partition perpendicular to the tension mask, a lower plane perpendicularly bent from the partition with a certain width to be opposed to the tension mask, and a support bent from the lower plane to support the partition at the outer edge, and wherein widths of a middle portion and of both ends of the lower plane are formed in the range of the following equation:

$$0 < \frac{y_1 - y_2}{y_2} \leq 1.0,$$

where $y_1$ is the width of the middle portion, and $y_2$ is the width of both ends.

7. The tension mask assembly according to claim 2, wherein widths of a middle portion and both ends of the support are formed in the range of the following equation:

$$0 < \frac{d_1 - d_2}{d_2} \leq 1.0,$$

where $d_1$ is the width of the middle portion, and $d_2$ is the width of both ends.

8. The tension mask assembly according to claim 2, wherein the electron beam through holes are shaped as a slot or grill.

9. The tension mask assembly according to claim 2, wherein the main frames are welded to the at least one subframe.

10. The tension mask assembly according to claim 2, wherein a shape of the lower plane is one of curved, rounded, rectangular, triangular, or any combination thereof.

11. A cathode ray tube containing the tension mask assembly of claim 2.

12. A tension mask assembly, comprising:

a tension mask having electron beam through holes disposed therein;

at least one sub-frame configured to support the tension mask under tension; and main frames attached to the tension mask, wherein each of the main frames includes a first portion extending perpendicular to the tension mask and a second portion extending perpendicular to the first portion defining a lower plane, and wherein a width of a middle portion of the lower plane is greater than a width of edge portions of the lower plane, the width of the edge portions being greater than zero.

13. The tension mask assembly according to claim 12, wherein a shape of the lower plane is one of curved, rounded, rectangular, triangular, or any combination thereof.

14. The tension mask assembly according to claim 12, wherein each of the main frames further comprises a third portion bent from the lower plane and configured to support the first portion, such that the main frame has a triangular cross section.

15. The tension mask assembly according to claim 12, wherein a width of a middle portion of the third portion is greater than a width of the edge portions of the third portion.

16. A cathode ray tube containing the tension mask assembly of claim 12.

17. The tension mask assembly according to claim 12, wherein the widths of the middle portion and edge portions of the second portion of the main frames satisfy the following equation:

$$0 < \frac{w_1 - w_2}{w_2} \leq \text{a first prescribed value}$$

$w_1$ is the width of the middle portion and $W_2$ is the width of the edge portions.

18. The tension mask assembly according to claim 17 wherein the first prescribed value equals 1.0.

19. The tension mask assembly according to claim 12, wherein the widths of the middle portion and edge portions of the third portion of the main frames satisfy the following equation:

$$0 < \frac{d_1 - d_2}{d_2} \leq \text{a second prescribed value}$$

where $d_1$ is the width of the middle portion and $d_2$ is the width of the edge portions.

20. The tension mask assembly according to claim 19, wherein the second prescribed value equals 1.0.

21. The tension mask assembly according to claim 12, wherein the at least one sub frame is attached to the lower plane of the main frame.

22. The tension mask assembly according to claim 21, wherein the at least one subframe is welded to the lower plane of the main frame.

23. The tension mask assembly according to claim 21, wherein the at least one subframe is attached to a bottom surface of the lower plane of the main frame.

* * * * *